US010290485B2

(12) United States Patent
Baba et al.

(10) Patent No.: US 10,290,485 B2
(45) Date of Patent: May 14, 2019

(54) FOURIER TRANSFORM ION CYCLOTRON RESONANCE MASS SPECTROMETRY

(71) Applicant: DH Technologies Development PTE Ltd., Singapore (SG)

(72) Inventors: Takashi Baba, Richmond Hill (CA); Alex Berlyand, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/531,367

(22) PCT Filed: Nov. 24, 2015

(86) PCT No.: PCT/IB2015/059103

§ 371 (c)(1),
(2) Date: May 26, 2017

(87) PCT Pub. No.: WO2016/084005

PCT Pub. Date: Jun. 2, 2016

(65) Prior Publication Data

US 2017/0358437 A1 Dec. 14, 2017

Related U.S. Application Data

(60) Provisional application No. 62/085,459, filed on Nov. 28, 2014.

(51) Int. Cl.

| | |
|---|---|
| ***H01J 49/00*** | (2006.01) |
| ***H01J 49/06*** | (2006.01) |
| ***H01J 49/38*** | (2006.01) |

(52) U.S. Cl.

CPC ..... *H01J 49/063* (2013.01); *H01J 49/38* (2013.01)

(58) Field of Classification Search

CPC ..... H01J 49/063; H01J 49/38
USPC ..... 250/281, 282, 290, 291
See application file for complete search history.

(56) References Cited

U.S. PATENT DOCUMENTS

| | | | |
|---|---|---|---|
| 2,829,260 | A | 4/1958 | Donner et al. |
| 5,455,418 | A | 10/1995 | Hogan |
| 2005/0178961 | A1 | 8/2005 | Beu et al. |
| 2008/0099672 | A1 | 5/2008 | Kim et al. |
| 2009/0008544 | A1 | 1/2009 | Ryjkov |

(Continued)

OTHER PUBLICATIONS

International Search Report and Written Opinion for PCT/IB2015/059103 dated Feb. 29, 2016.

(Continued)

*Primary Examiner* — Michael Maskell

(57) ABSTRACT

Methods and systems for analyzing ions in a magnetic ion trap are provided herein. In accordance with various aspects of the present teachings, the methods and systems described herein enable Fourier transform ion cyclotron resonance mass spectrometry across relatively narrow gap magnetic fields substantially perpendicular to the axis along which the ions are injected into the ion trap. As a result, smaller, less expensive magnets can be used to produce the high-intensity, uniform magnetic fields utilized in high performance FT-ICR/MS applications. Accordingly, the present teachings enable permanent magnets (as well as electromagnets) to generate these magnetic fields, potentially reducing the cost, size, and/or complexity of the systems described herein relative to conventional FT-ICR systems.

25 Claims, 9 Drawing Sheets

(56) References Cited

U.S. PATENT DOCUMENTS

| | | | | |
|---|---|---|---|---|
| 2009/0218485 | A1* | 9/2009 | Kaiser | H01J 49/38<br>250/283 |
| 2014/0224972 | A1 | 8/2014 | Baykut et al. | |

OTHER PUBLICATIONS

Stahl S et al., "A planar Penning trap", The European Physical Journal D; Atomic, Molecular and Optical Physics, Societa Italiana Di Fisica, BO, vol. 32, No. 1, Dec. 7, 2004, pp. 139-146.

J. Goldman et al., "Optimized planar Penning traps for quantuminformation studies", Physical Review A (Atomic, Molecular, and Optical Physics), vol. 81, No. 5, May 24, 2010, p. 052335-1.

* cited by examiner

FOURIER TRANSFORM ION CYCLOTRON RESONANCE MASS SPECTROMETRY

RELATED APPLICATIONS

This application claims the benefit of priority from U.S. Provisional Application Ser. No. 62/085,459, filed on Nov. 28, 2014, the entire contents of which is hereby incorporated by reference herein.

FIELD

The teachings herein relate to magnetic ion traps, and more particularly, to methods and systems for performing Fourier transform ion cyclotron resonance mass spectrometry using a magnetic ion trap.

INTRODUCTION

Mass spectrometry (MS) is an analytical technique that allows the determination of the mass-to-charge ratio (m/z) of ions of sample molecules. Generally, mass spectrometry involves ionizing sample molecule(s) and analyzing the ions in a mass analyzer. One exemplary MS technique known in the art is Fourier transform ion cyclotron resonance mass spectrometry (FT-ICR). FT-ICR has received considerable attention for its ability to make accurate, high resolution mass measurements.

FIG. 1 demonstrates the general structure of one FT-ICR mass spectrometer system 100 known in the art. FT-ICR mass spectrometer system 100 includes an ion source 110, a first mass analyzer 120, and an FT-ICR unit 140. In operation, the first mass analyzer 120 (e.g., linear quadrupole electrodes 122 to which RF and/or DC voltages can be applied) receives ions from the ion source 110 and filters those ions (e.g., selectively transmits ions of a selected m/z range) to the downstream elements to be further analyzed.

In known systems, the FT-ICR unit 140 generally comprises a magnetic ion trap (e.g., a Penning trap) having a ring electrode 142 and two end-cap electrodes 144*a,b*. The end-cap electrodes 144*a,b* include orifices 146 disposed on the central, longitudinal axis (A) of the MS system 100 through which ions are received from the ion source 110/first mass analyzer 140 and through which the ions are transmitted to downstream elements (e.g., mass analyzer 160), respectively. In order to trap the charged particles, FT-ICR units like that shown in FIG. 1 generally utilize a static electric field generated between the end-cap electrodes 144*a,b* (typically maintained at a DC voltage of the same polarity as the ions to be trapped) and the ring electrode 142 (typically maintained at a DC voltage of the opposite polarity as the ions to be trapped) to confine the ions axially (i.e., in the z-direction along the central axis (A) between the orifices 146 of the end-cap electrodes 144*a,b*). Additionally, a static, uniform magnetic field (B, typically not less than 1 T) is applied along the direction in which ions are injected (i.e., along the central axis (A)) so as to confine the charged particles radially (i.e., in the x- and y-directions, perpendicular to the axis of the magnetic field).

As is known in the art, an ion of a particular charge (q) and mass (m) moving in a uniform magnetic field (B) experiences a Lorentz force ($qv \times B$) perpendicular to the axis of the magnetic field and the ion's velocity v. In the absence of a disturbing force (e.g., an electric field), the ions exhibit simple, circular motion, commonly referred to as cyclotron motion. The frequency of the ion's cyclotron rotation ($f_c$)is dependent on the m/z ratio of the ion ($f_c = qB/2\pi m$).

On the other hand, the electrostatic potentials applied to the electrodes 142, 144*a,b* create a saddle point in the trap center that would cause the ions to be accelerated from the trap center toward the ring electrode 142 in the absence of the magnetic field. However, when the effects of the electrostatic potentials and the magnetic field (B) are combined, the result is cyclotron motion and magnetron motion, a relatively slow circular motion around the trap center (i.e., central axis (A)) in which the outward electrostatic force and the centripetal Lorentz force are substantially and continuously balanced. That is, in FT-ICR units known in the art, the trapped ions experience both cyclotron and magnetron motion (with the center of the magnetron motion being about the central axis (A), and the center of the cyclotron motion following the magnetron orbit, instead of being fixed). The magnetic field applied along the magnetic field axis in a Penning trap (i.e., along the central axis (A)) generally effects the radial confinement of the ions, while the electrostatic field causes the ions to oscillate axially along the direction of the axis of the magnetic field.

In some conventional FT-ICR units like that depicted in FIG. 1, multiple species of trapped ions having different m/z are excited to a higher orbit (i.e., the radius of the cyclotron motion increases) by applying pulsed DC voltage. This ion motion induces an electric current on electrodes of the FT-ICR unit, and the current is detected by an AC current detecting circuit. The detected current intensity has the cyclotron frequency ($f_c$) of a species of trapped ions and shows the number of trapped ions of that particular m/z. The time-domain signals of the detected currents generated by the various resonantly-excited ions can be deconvoluted/converted via known Fourier transform techniques to a frequency-domain signal, thereby resulting in a mass spectrum.

Because the resolution capability of FT-ICR is generally related to the uniformity and intensity of the magnetic field to which the ions are subjected (e.g., certain performance features vary as a function of the square of the intensity of the magnetic field such that a minimum value of about 1 T is recommended in high performance MS applications), magnetic ion traps for FT-ICR have traditionally utilized strong electromagnets or super-conducting electromagnets (e.g., solenoid 148, within which the ring electrode 142 and end-cap electrodes 144*a,b* are housed) to produce the high-intensity magnetic fields (e.g., at least 1 T, sometimes as high as 7-15 Tesla) along the central axis (A), as schematically depicted in FIG. 1 by the arrow indicating the direction of the magnetic field (B). Such electromagnets, however, can be extremely expensive and cumbersome (e.g., heavy, bulky), and require complex power supplies and/or cooling installations for operation.

Though FT-ICR systems utilizing permanent magnets have been proposed to address the expense of systems utilizing electromagnets (see U.S. Pat. No. 6,822,223, entitled "Method, System and Device for Performing Quantitative Analysis Using an FTMS," issued Nov. 23, 2004; U.S. Pat. No. 6,989,533, entitled "Permanent Magnet Ion Trap and A Mass Spectrometer Using Such a Magnet," issued Jan. 24, 2006; Vilkov, A. N. et al., "Atmospheric Pressure Ionization Permanent Magnet Fourier Transform Ion Cyclotron Resonance Mass Spectrometry," J Am Soc Mass Spectrom, vol. 18(8):1552-1558 (2007), each of which is incorporated herein in its entirety), such permanent magnet systems nonetheless require complex arrangements/large permanent magnets (e.g., Halbach cylinders as in U.S. Pat. No. 6,989,533) in order to generate sufficient magnetic field strength and uniformity within the trapping electrodes of the FT-ICR unit 140 along the ion injection axis (i.e., central axis (A)).

The high cost and limited mobility of FT-ICR systems resulting from the size of the magnets (electromagnets or permanent) has heretofore limited the adoption of FT-ICR despite the technique's potential benefits (e.g., high accuracy and resolution). Accordingly, there remains a need for improved FT-ICR units and mass spectrometer systems incorporating the same.

SUMMARY

Described herein are methods and systems for analyzing ions in a magnetic ion trap, and more particularly, to methods and systems for performing Fourier transform ion cyclotron resonance mass spectrometry. In accordance with various aspects of the present teachings, the FT-ICR cells described herein have relatively narrow gaps into which the ions are injected, thereby enabling smaller and less expensive magnets to be used to produce the high-intensity, uniform magnetic fields typically required for high performance MS applications. Though the methods and systems described herein can alternatively utilize electromagnets (normal or superconducting), permanent magnets are particularly suitable for generating the high-intensity magnetic fields, while reducing the expense, size, and complexity of the systems relative to conventional FT-ICR systems. In various aspects, the present teachings enable ions to be injected into the magnetic ion traps along an injection axis that is substantially perpendicular to the axis of the magnetic field.

In accordance with one aspect, certain embodiments of the applicant's teachings relate to a mass spectrometer system comprising a magnetic ion trap extending from an input end to a distal end along a central axis, the input end configured to receive ions from an ion source. The exemplary magnetic ion trap comprises at least one magnet for generating a magnetic field within the magnetic ion trap that is substantially perpendicular to the central axis, as well as a plurality of electrodes extending along opposed sides of the central axis. Electric signals are applied to the plurality of electrodes so as to generate an electric field within the magnetic ion trap such that the combination of the magnetic and electric fields cause ions trapped within the magnetic ion trap to exhibit cyclotron and magnetron motion. In various aspects, the magnetron motion occurs about an axis substantially perpendicular to the central axis, the cyclotron and magnetron motion exhibiting a detectable cyclotron frequency.

In accordance with various aspects of the present teachings, the system can also comprise a detector and/or processer for determining a cyclotron frequency of ions trapped by the magnetic ion trap. For example, the system can include a detector for detecting an induced current between at least two of the plurality of electrodes, the induced current being indicative of the cyclotron frequency of the trapped ions. In one aspect, the detector can comprise AC current tracing electronics and a processer can be configured to convert the detected induced current to cyclotron motion frequencies of the ions using Fourier analysis. In some aspects, at least one of the plurality of electrodes can be configured to have an excitation signal applied thereto so as to increase the orbit of the cyclotron motion of the ions, and such that the detector can detect an induced current between at least two of the plurality of electrodes during excitation of the ions. By way of non-limiting example, the excitation signal can comprise a DC pulse applied to at least one of the plurality of electrodes.

In accordance with various aspects of the present teachings, the mass spectrometer system can additionally include one or more elements. By way of example, mass spectrometer systems described herein can include an ion source for generating ions from a sample. Additionally, in some aspects, an ion guide can be disposed between the ion source and the input end of the magnetic ion trap, the ion guide being configured to transmit ions into the magnetic ion trap along the central axis. In one aspect, the system can also include a downstream mass analyzer configured to receive ions from the magnetic ion trap along the central axis.

As noted above, in many embodiments of the present teachings, the magnetic field can exhibit a magnetic field axis substantially perpendicular to the central axis along which the ions are transmitted into the trap. Such a magnetic field can be generated in a variety of manners and can exhibit a variety of characteristics, though the magnetic field is generally of sufficient strength and uniformity to enable high-resolution detection of the ions trapped within the magnetic ion trap. By way of non-limiting example, the at least one magnet can be configured to generate a substantially uniform magnetic field within the magnetic ion trap (e.g., between the electrodes) exhibiting a strength of at least 1 T (e.g., about 2 T, about 3 T) along the magnetic field axis extending between the plurality of electrodes. In various aspects, the magnetic field can be substantially uniform between the electrodes and along the central axis within the magnetic ion trap.

In accordance with various aspects of the present teachings, a variety of magnets modified in accordance with the present teachings can be used to generate such magnetic fields within the magnetic ion trap. For example, the at least one magnet can be an electromagnet (e.g., normal or superconducting) or a permanent magnet. In one aspect, the at least one magnet can comprise first and second permanent disc magnets disposed on opposed sides of the central axis. The permanent disc magnets can have a variety of configurations. By way of example, each of the first and second permanent disc magnets can terminate in a substantially planar surface that is substantially parallel to the planar surface of the other (e.g., so as to define a gap between the planar surfaces of the first and second permanent disc magnets across the central axis, the planar surfaces being separated by a substantially constant distance). The permanent disc magnets can also have a variety of shapes and be comprised of a variety of materials. By way of non-limiting example, the first and second permanent disc magnets can comprise neodymium. In some aspects, the first and second disc permanent magnets can be cylindrical.

It will also be appreciated in accordance with various aspects of the present teaching that the magnets for generating the magnetic field within the magnetic ion trap can include one or more additional features for increasing the strength and/or uniformity of the magnetic field. In one aspect, for example, first and second pole pieces (e.g., truncated, conical portions) can extend from terminal ends of first and second permanent disc magnets, respectively, with each of the pole pieces terminating in a planar surface having a reduced area relative to the area of the terminal ends of the first and second permanent disc magnets so as to define a gap between the parallel planar surfaces across the central axis (e.g., a gap between the planar surfaces having a substantially constant minimum distance between the planar surfaces).

In such an aspect, the first and second permanent disc magnets can comprise neodymium, for example, while the reduced-diameter pole pieces can comprise iron. Additionally or alternatively, in some aspects, the first and second permanent disc magnets can be coupled via a magnetic flux return yoke, which can also be made of iron, for example.

The plurality of electrodes for generating the electric field within the magnetic ion trap can also have a variety of configurations. By way of example, the plurality of electrodes can comprise a first set of a plurality of electrodes disposed on one side of the central axis and a second set of a plurality of electrodes disposed on the opposed side of the central axis. In related aspects, each of first and second set of the plurality of electrodes can comprise a plurality of substantially planar electrodes, with the first and second sets being disposed on opposed sides of the central axis. In some aspects, each of the substantially planar electrodes can comprise a conductive planar surface separated from adjacent electrodes by non-conductive portions. For example, each of the plurality of substantially planar electrodes can be formed on a printed circuit board, which in some aspects, can be supported by (e.g., coupled to) the magnet(s).

In one aspect of a system in accordance with the present teachings, the first set of the plurality of electrodes can comprise a central circular electrode and at least two electrodes that surround the central circular electrode. By way of example, the at least two electrodes that surround the central circular electrode can comprise an inner ring of electrodes. In one aspect, a detector could then detect an induced current between an electrode of the inner ring and the central circular electrode. Additionally, an outer ring of electrodes can surround the inner ring, and in some aspects, a detector can be configured to detect an induced current between an electrode of the inner ring and an electrode of the outer ring.

In accordance with various aspects of the present teachings, certain embodiments relate to a method of analyzing ions that comprises trapping and/or detecting ions utilizing the magnetic ion traps described herein. For example, in various aspects of the present teachings, a method of analyzing ions is provided that comprises receiving along a central axis a plurality of ions at an input end of a magnetic ion trap, the magnetic ion trap comprising at least one magnet (e.g., electromagnet, permanent) for generating within the magnetic ion trap a magnetic field substantially perpendicular to the central axis and a plurality of electrodes to which electric signals are applied so as to generate an electric field within the magnetic ion trap. The method can also include trapping the plurality of ions within the magnetic ion trap such that the ions exhibit cyclotron and magnetron motion therewithin.

In some aspects, the method can also include detecting an induced current between at least two of the plurality of electrodes. For example, in a magnetic ion trap in which the plurality of electrodes comprise a first set of a plurality of electrodes disposed on one side of the central axis and a second set of a plurality of electrodes disposed on the opposed side of the central axis, with the first set of the plurality of electrodes comprising a central circular electrode and an inner ring of electrodes surrounding the central circular electrode, the method can comprise detecting an induced current between an electrode of the inner ring and the central circular electrode.

Additionally or alternatively, in one aspect, the method can comprise detecting an induced current between at least two of the plurality of electrodes after applying an excitation signal to at least one of the plurality of electrodes so as to increase the orbit of the cyclotron motion of the ions. In related aspects, the excitation signal can comprise a DC pulse applied to at least one of the plurality of electrodes. For example, in a magnetic ion trap having a first set of electrodes comprising a central circular electrode, an inner ring of electrodes, and an outer ring of electrodes, the method can comprise detecting an induced current between an electrode of the inner ring and an electrode of the outer ring after excitation.

In some aspects, the method can include wherein the first set and the second set of the plurality of electrodes comprise a first and a second printed circuit board. In some aspects, the first set of the plurality of electrodes comprises a central circular electrode and an inner ring of electrodes surrounding the central circular electrode.

In some aspects, the method can additionally comprise using Fourier analysis (e.g., FFT) to analyze the detected induced current in order to determine the cyclotron motion frequencies of the trapped ions. In some aspects, the method can also comprise transmitting the ions from the magnetic ion trap to a downstream mass analyzer along the central axis.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

Methods and systems for analyzing ions in a magnetic ion trap are provided herein. In accordance with various aspects of the present teachings, the methods and systems described herein enable Fourier transform ion cyclotron resonance mass spectrometry across a relatively narrow gap magnetic field into which the ions are injected such that smaller, less expensive magnets can be used to produce the high-intensity, uniform magnetic fields typically necessary for high performance MS applications. Though the use of electromagnets (normal or superconducting) are within the scope of the present teachings, the present teachings particularly enable permanent magnets to be used to generate the magnetic fields, thereby reducing cost, size, and/or complexity relative to conventional FT-ICR systems. In various aspects, the present teachings enable ions to be injected into the magnetic ion traps along an injection axis that is substantially perpendicular to the axis of the magnetic field. In some aspects, the narrow FT-ICR cells described herein can be formed between a pair of planar printed circuit boards (PCBs) separated by a narrow gap into which the ions are injected and disposed within the magnetic field such that the plane of the PCBs is parallel to the injection axis and substantially perpendicular to the axis of the magnetic field.

Figure 2:
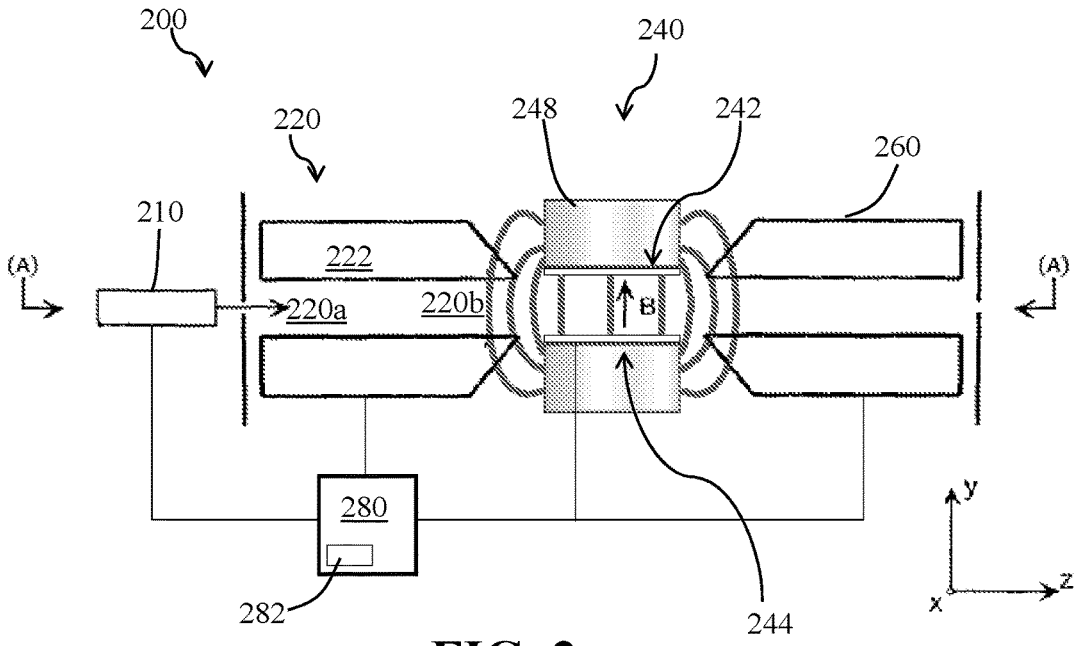
FIG. 2, in schematic diagram, depicts a mass spectrometer system having a magnetic ion trap in accordance with one aspect of various embodiments of the applicant's teachings FIG. 3 schematically depicts an exemplary PCB for use as one set of a plurality of electrodes for use in the magnetic ion trap of FIG. 2.

With reference now to FIG. 2, an exemplary mass spectrometry system 200 in accordance with various aspects of applicant's teachings is illustrated schematically. As will be appreciated by a person skilled in the art, the mass spectrometry system 200 represents only one possible configuration in accordance with various aspects of the systems, devices, and methods described herein. As shown in FIG. 2, the exemplary mass spectrometry system 200 generally comprises an ion source 210 for generating ions from a sample of interest, an ion guide 220 for focusing and/or filtering the ions to be transmitted thereby, a magnetic ion trap 240, and a downstream mass analyzer 260. As described in detail below, the exemplary magnetic ion trap 240 includes a plurality of electrodes 242, 244 for generating an electric field within the magnetic ion trap 240 and at least one magnet 248 for generating a magnetic field between the electrodes 242, 244 such that the ions can be trapped via the combination of the effects thereon of the electric and magnetic fields.

It should be appreciated by the skilled artisan that the magnetic ion trap 240 can be contained within a vacuum chamber (not shown) to reduce the ions' collision with ambient gas molecules, as known in the art. The vacuum chamber can be evacuated to high vacuum (HV) or ultra high vacuum (UHV), by way of non-limiting example, using mechanical pumps (e.g., turbo-molecular pumps, rotary pumps) to evacuate the vacuum chamber to appropriate pressures. Though only downstream mass analyzer 260 is shown, a person skilled in the art will appreciate that systems in accordance with the present teachings can include additional mass analyzer elements downstream from the magnetic ion trap 240 (or none, as described below with reference to mass spectrometer system 700 of FIGS. 7 and 8). Likewise, one or more additional mass analyzers other than ion guide 220 can be included upstream from the magnetic ion trap 240. By way of example, the ions that are processed within the magnetic ion trap 240 in accordance with the present teachings can be transported through one or more differentially pumped vacuum stages containing one or more mass analyzer elements before and/or after being processed in the magnetic ion trap 240. For instance, in some aspects, the system 200 can comprise a multi-stage quadrupole mass spectrometer in which the ions are transmitted from the ion source 210 through multiple differentially pumped vacuum stages, during which additional ion processing steps can occur such as filtering, focusing, and dissociation. In an exemplary embodiment, for example, the ions can be transmitted into a first stage maintained at a pressure of approximately 2.3 Torr, a second stage maintained at a pressure of approximately 6 mTorr, and a third stage maintained at a pressure of approximately $10^{-5}$ Ton. The third vacuum stage can contain, for example, a detector, as well as a quadrupole mass analyzer (Q1), a collision cell (Q2), and the magnetic ion trap 240. In this manner, sample ions can thus be filtered within Q1 and dissociated into product ions within Q2 prior to being injected into the magnetic ion trap. It will be apparent to those skilled in the art that there may be a number of other ion optical elements in the system. This example is not meant to be limiting as it will also be apparent to those of skill in the art that the magnetic ion traps described herein can be utilized in many mass spectrometer systems. These can include time of flight (TOF), ion trap, quadrupole, or other mass analyzers, as known in the art and modified in accordance with the present teachings.

The ion source 210 can also be any ion source known in the art or hereafter developed and modified in accordance with the present teachings. A person skilled in the art will appreciate that the ion source 110 can be virtually any ion source known in the art, including for example, a continuous ion source, a pulsed ion source, an electrospray ionization (ESI) source, an atmospheric pressure chemical ionization (APCI) source, an inductively coupled plasma (ICP) ion source, a matrix-assisted laser desorption/ionization (MALDI) ion source, a glow discharge ion source, an electron impact ion source, a chemical ionization source, or a photoionization ion source, among others. By way of non-limiting example, the sample can additionally be subjected to automated or in-line sample preparation including liquid chromatographic separation.

In various aspects, ions generated by the ion source 210 can be injected into the magnetic ion trap 240 substantially along the central axis (A). By way of example, the exemplary ion guide 220 can utilize quadrupolar RF focusing so as to generate a coherent, narrow beam of a plurality of ions transmitted into the magnetic ion trap 240. In accordance with various aspects of the applicant's present teachings, the ion guide 240 comprises four rods 222 extending from an inlet end 220*a* to an outlet end 220*b* along a longitudinal, central axis (A). As will be appreciated by a person skilled in the art, an RF signal applied to the rods 222 can be sufficient to generate a quadrupole RF field that maintains the ions substantially along the central axis (A) for injection into the magnetic ion trap 240.

After being transmitted into the magnetic ion trap 240 and into the space bounded by the electrodes 242, 244 disposed on opposed sides of the central axis (A), the ions are subjected to the magnetic and electric fields generated therein via the magnet(s) 248 and the electrodes 242, 244. As schematically depicted in FIG. 2, for example, the magnet(s) 248 can be configured to generate a magnetic field (B) within the magnetic ion trap 240 having a magnetic field axis that is substantially perpendicular to the injection axis/central axis (A). As discussed above and as will be appreciated by a person skilled in the art in light of the present teachings, the ion's trajectory will generally exhibit cyclotron motion with a drift (as the center of cyclotron motion translates) as a result of the combined effect of the magnetic and electric fields within the magnetic ion trap 240. Moreover, as discussed in detail below, the electrodes 242, 244 can have various electric potentials applied thereto so as to change the electric field within the magnetic ion trap 240, thereby altering the amplitude of the ions' cyclotron motion and/or the trajectory of the ions' drift.

The at least one magnet 248 can have a variety of configurations for generating a magnetic field within the magnetic ion trap in accordance with the present teachings. By way of non-limiting example, the at least one magnet 248 can be one or more permanent magnets (i.e., an object made from magnetized material that creates its own magnetic field) or an electromagnet (e.g., a solenoid that generates a magnetic field when an electric current flows therethrough) that are configured to generate a uniform, high-intensity magnetic field within the gap between the electrodes 242, 244 in a direction substantially perpendicular to the injection axis. The one or more permanent magnets, for example, can comprise a variety of magnetized materials and composites containing the same. By way of non-limiting example, the magnetized material can comprise naturally-occurring or magnetized magnetic metallic elements (e.g., iron ores, cobalt, nickel), rare-earth elements (e.g., samarium, neodymium), and composites (e.g., iron oxide and barium/strontium carbonate ceramic, samarium-cobalt, neodymium-iron-boron). In various aspects, neodymium-based permanent magnets may be preferred in view of their generation of intense magnetic fields. Exemplary electromagnets include normal electric and superconducting magnets, by way of non-limiting example.

Additionally, the one or more magnets 248 can have a variety of configurations (e.g., shapes, a plurality of structured magnetic elements) configured to generate a uniform, high-intensity magnetic field within the gap between the electrodes 242, 244 in a direction substantially perpendicular to the injection axis (A). With specific regard to permanent magnets, it will be appreciated by a person skilled in the art in light of the present teachings that a single bar magnet, block magnets, cylindrical magnets, and ring magnets, all by way of non-limiting example, can be arranged within the mass spectrometer system 200 so as to generate a magnetic field having a magnetic field axis substantially perpendicular to the injection axis (A) of the ions. Likewise, it will be appreciated that any electromagnet (normal or superconducting, bored or unbored) or any other type of large volume uniform magnetic field generator known in the art or hereafter developed can be similarly arranged to provide the magnetic field within the magnetic ion trap 240 in accordance with the present teachings With specific reference to the exemplary system 200 depicted in FIG. 2, the magnetic field in the gap between the electrodes 242, 244 is generated by two permanent disc magnets 248 comprising neodymium that are disposed on opposed sides of the central axis (A). The disc magnets 248 each terminate in a planar surface (i.e., the surface closest to the central axis) that is parallel to the central axis (A), thereby defining a gap between the electrodes that extends across the central axis (A) (e.g., the gap exhibits a substantially constant minimum distance between the planar surfaces). As shown in FIG. 2, the magnetic flux lines between the disc magnets 248 generates a substantially uniform magnetic field within the magnetic ion trap 240 having a magnetic axis that is substantially perpendicular to the central axis (A).

As noted above, the electrodes 242, 244 can also have a variety of configurations in accordance with the present teachings such that various electric potentials can be applied thereto so as to change the electric field within the magnetic ion trap 240, thereby altering the amplitude of ions' cyclotron motion and/or the trajectory of the ions' drift. In accordance with the present teachings, for example, the electrodes 242, 244 can be configured to alternatively generate electric fields within the magnetic ion trap 240 for transmitting the ions through the magnetic ion trap 240 (FIG. 4), trapping the ions within the magnetic ion trap 240 (FIG. 5), and/or exciting the ions within the magnetic ion trap 240 (FIG. 6).

In some aspects, each of the electrodes 242, 244 can comprise a plurality of electrodes (a . . . n, where n is a whole number greater than 1). That is, one set (e.g., 242) of a plurality of electrodes (e.g., 242*a* . . . n) can be disposed on one side of the central axis and a second set (e.g., 244) of a plurality of electrodes (e.g., 244*a* . . . n) can be disposed on the opposed side of the central axis for generating the electric fields within the ion traps in accordance with the present teachings. Each of the individual electrodes of the set can have a variety of configurations (e.g., shape, size, arrangement) and can be configured to have an electric potential (e.g., a DC voltage) applied thereto independent of the electric potentials applied to the other electrodes of the same set. By varying the potentials applied to the electrodes of each set of electrodes, the resulting electric field within the magnetic ion trap can be configured to alter the ions' motion, as discussed in detail below.

Figure 3:
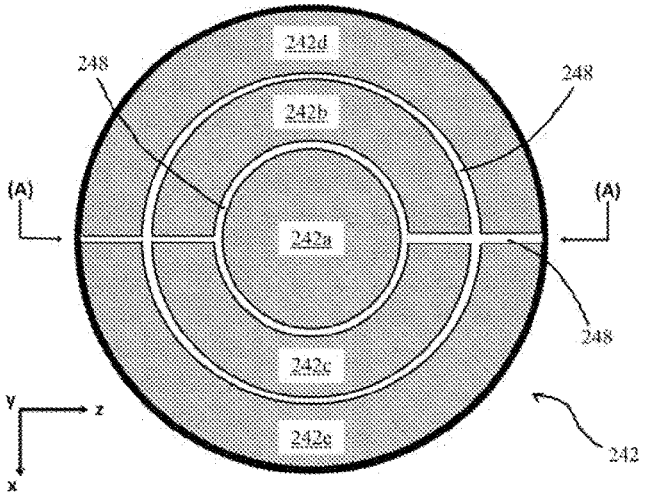

With reference now to FIG. 3, one exemplary electrode 242 suitable for use in accordance with the present teachings is shown in detail. As shown in FIG. 3, the exemplary electrode 242 comprises a substantially planar surface that is configured to be disposed parallel to the central axis (A) of the magnetic ion trap 240. Also as shown, portions of the inner surface of the electrode 242 (i.e., the surface facing the chamber through which the ions are transmitted) can comprise an electrically conductive material to which a DC potential can be applied. By way of non-limiting example, the electrically conductive portions can comprise gold plated copper or stainless steel. In accordance with various aspects of the present teachings, various portions of the conductive surface can be separated by non-conductive portions 248 such that conductive portions of the surface are electrically isolated from one another. For example, as shown in FIG. 3, the non-conductive portions 248 can be configured to divide the electrode 242 into five regions, to which distinct electric potentials can be applied, though more or fewer regions may be defined in accordance with the present teachings. In the exemplary depicted system, the electrode 242 (i.e., the top electrode depicted in FIG. 2) comprises a printed circuit board (PCB) defining a plurality of substantially planar electrodes (242*a-e*) separated by non-conductive portions 248.

In accordance with the present teachings, the conductive portions or electrodes 242*a-e* can have a variety of configurations and can be arranged in a variety of patterns for controlling the movement of ions through the magnetic ion trap 240. In the exemplary electrode 242 depicted in FIG. 3, for example, the electrode 242 comprises five individual conductive portions (though more or fewer conductive portions and conductive portions of various shapes can be utilized): a central circular electrode 242*a,* which is surrounded by two inner arch-shaped electrodes 242*b,c* that together form a ring around the central electrode 242*a* (separated therefrom by non-conductive portions 248), and which are surrounded by two outer arch-shaped electrodes 242*d,e* that together form a ring around the inner ring. It will be appreciated in view of the present teachings that the conductive portions that form the electrode 242 can comprise a plurality of shapes, the same or different shapes as one another. By way of non-limiting example, the electrodes can be substantially circular (e.g., electrode 242*a*) or arch-shaped (e.g., electrode 242*b*), or another shape for generating electric fields in accordance with the present teachings. In one aspect, for example, rather than having a single circular electrode as shown in FIG. 3, the center of the electrode can comprise two hemispherical electrodes to which the same or different voltages can be applied, as discussed below.

In some aspects, it may be desirable to minimize the thickness of the non-conductive portions 248, while nonetheless ensuring electrical isolation between the adjacent electrodes 242*a-e,* for example. Moreover, it will also be appreciated that in some aspects the gauge of the conductive material (e.g., copper foil on the PCB) can be thickened so as to avoid exposure of the underlying PCB dielectric material. In some aspects, plating the copper foil with gold may help to prevent surface oxidation.

Similarly, the electrode 244 (i.e., the bottom electrode of FIG. 2) can also comprise a plurality of substantially planar electrodes separated by non-conductive portions, with the shape and/or size of the conductive portions, their arrangement, and the potentials applied thereto varying in accordance with the present teachings. As discussed in detail below, by applying electric potentials to the various conductive portions of the electrodes 242, 244, the electric field to which the ions are exposed can be altered so as to control the movement of the ions within the magnetic ion trap 240. For example, the configuration (e.g., shape/size/position) of the various electrodes 242*a-e* and 244*a-e* of the opposed electrodes 242, 244 (and the electric potentials applied thereto) can be selected in accordance with the present teachings to inject ions into or transmit through the magnetic ion trap 240, trap a plurality of ions within the magnetic ion trap 240 such that the ions exhibit cyclotron and magnetron motion, and/or excite the ions within the magnetic ion trap 240 so as to increase the orbit of the ions' cyclotron motion, as discussed in detail below.

It will also be appreciated by a person skilled in the art in light of the present teachings that one or more power supplies (not shown) can be configured to apply electric signals (e.g. DC potentials) to the electrodes 242, 244 (or portions thereof). Likewise, as discussed in detail below, voltage pulse electronics can be provided to apply a DC pulse to the center electrode 242*a,* for example. Additionally, circuitry can also be provided to measure a current induced between various electrodes 242*a-e* based on the ion motion within the magnetic ion trap 240, for example, as discussed in detail below. By way of non-limiting example, AC current tracing electronics can be connected between various electrodes 242*a-e* in order to measure the frequenc (ies) of the induced current.

As shown in FIG. 2, the mass spectrometer system 200 can also include a controller 280 that can be operatively connected to one or more of the ion source 210, the ion guide 220, the magnet(s) 248 (e.g., electromagnet(s)), electrodes 242, 244, and the downstream mass analyzer 260 for controlling operation thereof By way of example, the controller 280 can be operatively coupled to the electrodes 242, 244 so as to control the magnetic ion trap settings (e.g., pass-through mode vs. trapping mode). By way of non-limiting example, the controller 280 can control the power source(s) to apply potentials to the electrodes 242, 244 (and the timing thereof), as discussed in detail below. It will further be appreciated that the system can also be associated with a processor (e.g., processor 282) configured, to convert analog induced current signals to digital (e.g., ADC), store the detected time domain signals, and/or deconvolute/convert the time domain signal into a frequency-domain mass spectrum (e.g., via FFT), all by way of non-limiting example.

Though the electrodes 242, 244 and the one or more magnets 248 are generally described herein as being arranged relative to one another such that the electrodes 242, 244 define a gap therebetween into which the ions are injected and the magnetic axis of the magnetic field is substantially perpendicular to the injection axis (A), it will nonetheless be appreciated in light of the present teachings that the electrodes 242, 244 can be disposed in a variety of manners relative to the one or more magnets 248 to provide for the combination of the electric and magnetic fields disclosed herein. By way of non-limiting example, an electromagnetic solenoid can be configured to surround the electrodes 242, 244 with its longitudinal axis extending through the electrodes 242, 244 so as to generate a magnetic field having a magnetic field axis substantially perpendicular to the injection axis (A) of the ions. Moreover, whereas FIG. 2 depicts permanent disc magnets 248 disposed on opposed sides of the central axis (A), a person skilled in the art would appreciate that a permanent bar magnet (e.g., disposed adjacent to the electrodes 242, 244 and having a longitudinal axis extending perpendicular to the planar electrodes 242, 244) could be configured to generate substantially uniform magnetic flux in the space between the electrodes in a direction substantially parallel to the injection axis of the ions.

In various aspects of the present teachings, methods and systems can enable a relatively narrow gap for receiving ions into the magnetic ion trap 240 and across/within which the magnetic and electric fields are applied. By way of example, the gap between the substantially, parallel electrodes 242, 244 can, in some aspects, be less than 0.5", less than 0.4", less than 0.3", less than 0.2", or less than 0.1". As a result of this decreased distance between the electrodes within which the motions of the ions are controlled in accordance with the present teachings, a high-intensity, uniform magnetic field can be produced even with a relatively small, inexpensive permanent magnet(s), as discussed otherwise herein. Moreover, it will be appreciated by a person skilled in the art in light of the present teachings that a magnetic field of maximum intensity and uniformity can be promoted by maintaining the magnets extremely close to the gap defined between the parallel electrodes. As shown in FIG. 2, for example, the electrodes 242, 244 need not be self-standing, but instead can be supported by (e.g., coupled to, mounted on, glued to) onto the planar surfaces of the magnets 248. In such a configuration, it will also be appreciated that the total thickness of the PCB 242, 244 can be made as thin as possible to avoid interfering with the magnetic field or separating the magnets 248 more than necessary. In one exemplary aspect, the gap between the PCBs can be as small as 0.1" (or even smaller).

Figure 4:
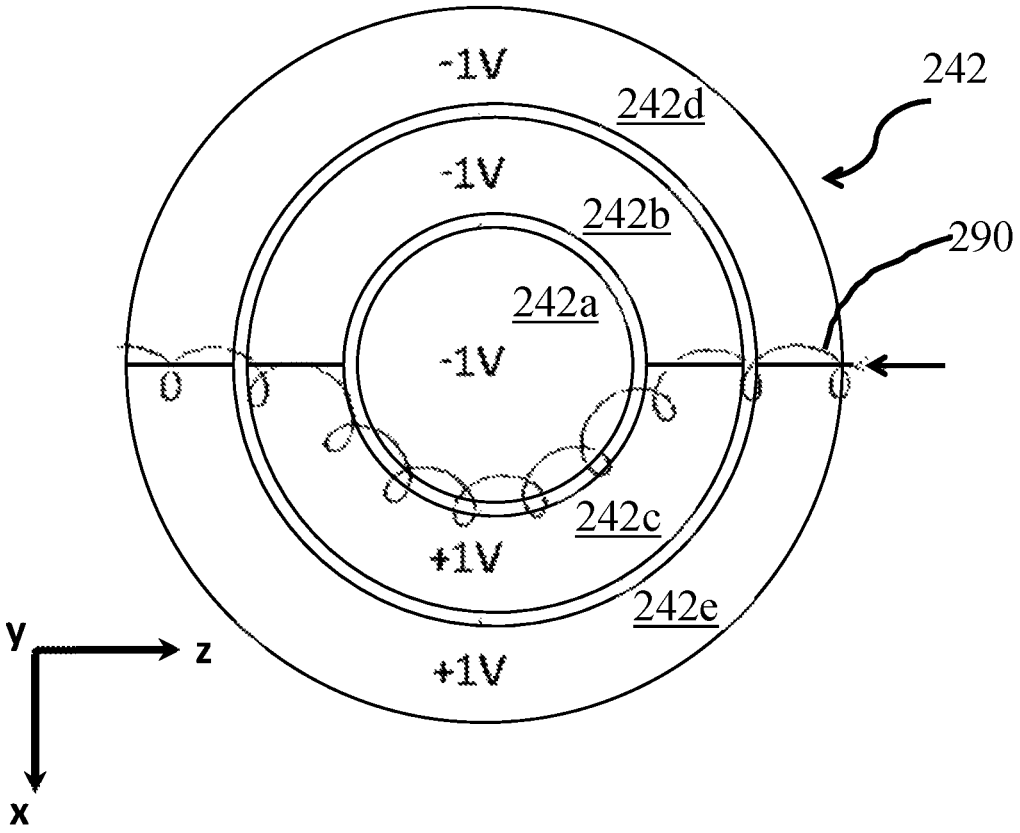
FIG. 4 depicts a SIMION simulation demonstrating the path of an exemplary cation during injection into the magnetic trap of FIG. 2, with the exemplary potentials being applied to the electrodes of the PCB of FIG. 3.
Figure 5:
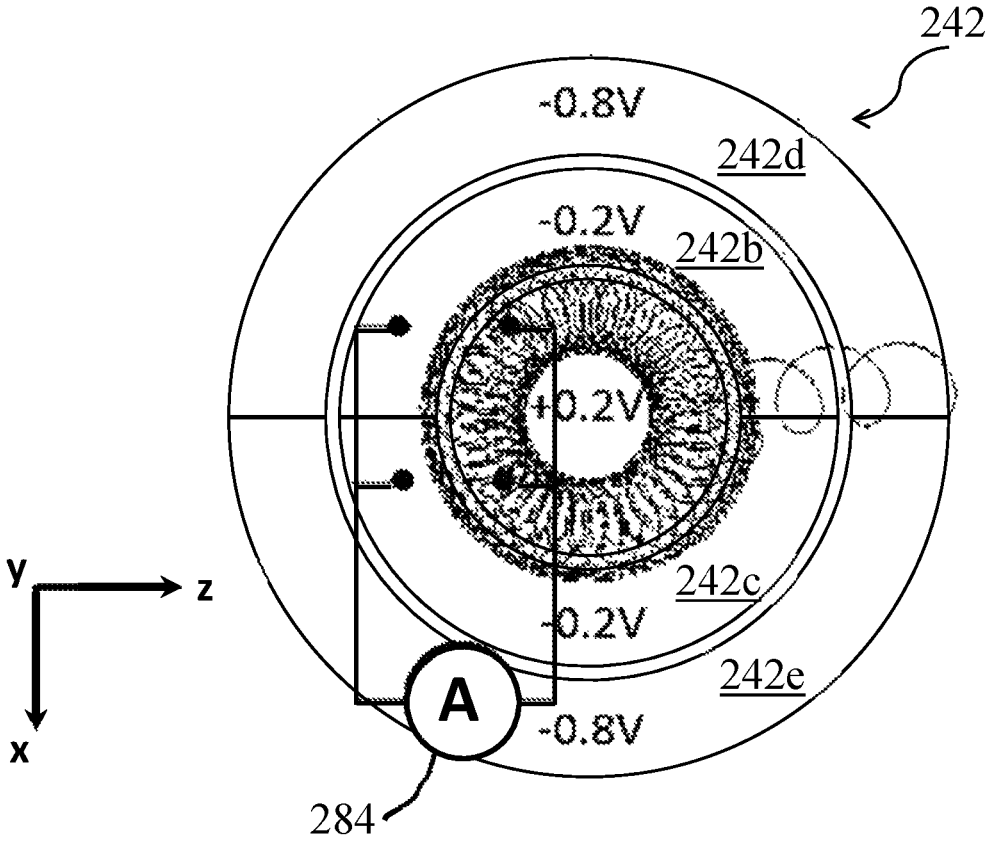
FIG. 5 depicts a SIMION simulation demonstrating the path of an exemplary cation during trapping by the magnetic trap of FIG. 2, with the exemplary potentials being applied to the electrodes of the PCB of FIG. 3.
Figure 6:
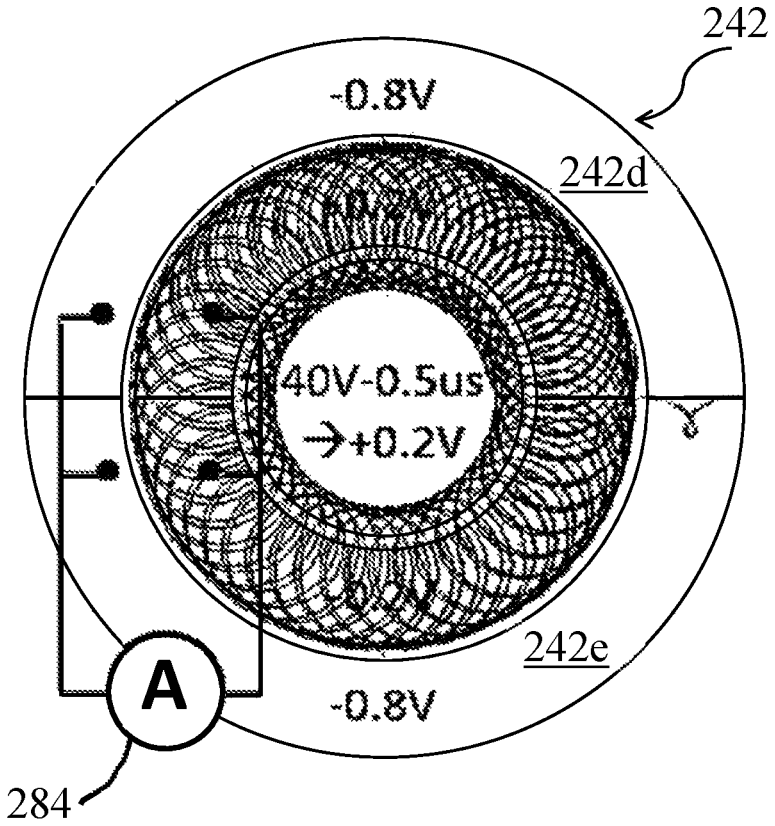
FIG. 6 depicts a SIMION simulation demonstrating the path of an exemplary cation during excitation thereof in the magnetic trap of FIG. 2, with the exemplary potentials being applied to the electrodes of the PCB of FIG. 3.

With reference now to FIGS. 4-6, simulated ion paths within the magnetic ion trap 240 having the exemplary PCB electrode 242 of FIG. 3 will now be described during various phases of exemplary methods of analyzing ions in accordance with the present teachings. Though only one electrode 242 (having a plurality of conductive portions or electrodes 242*a-e*) is depicted, the following description assumes that opposed, facing electrodes 244*a-e* of electrode 244 have the identical electrical signals applied thereto. Indeed, in accordance with various aspects of the present teachings, each of the electrodes 242*a-e* can be electrically connected (e.g., maintained at the same potential) with its corresponding electrode 244*a-e* in some aspects. For purposes of the following description, the magnetic axis extends through the plane of the page. It should also be appreciated that the values of the exemplary potentials are for illustrative purposes and do not necessarily limit the present teachings.

With reference first to FIG. 4, an exemplary SIMION simulation is depicted demonstrating the path of a cation 290 during its injection from the ion guide 220 into the magnetic trap 240, during which the depicted exemplary potentials are applied to the electrodes 242*a-e* of the PCB of FIG. 3 (SIMION is an ion motion simulator in vacuum provided by Scientific Instrument Service, Inc. NJ). As indicated by the arrow on the right side of the figure, the cation is injected into the gap between the electrodes 242, 244 substantially along the central axis of the ion guide 220, as discussed above. Upon entering the magnetic ion trap 240, the ion is subject to the electric field generated by the electrodes 242, 244 and the uniform magnetic field generated in the gap between the electrodes. As demonstrated schematically and understood by a person skilled in the art in light of the present teachings, the cation would tend to move along an equipotential line of superimposed electrical potential gradient within the uniform magnetic field generated by the magnets 248, with the cation's cyclotron motion overlapping on the transverse motion (drift). Accordingly, upon entering the magnetic ion trap 240, the cation proceeds initially along the non-conducting portion between the upper arch electrodes 242*d,b* (−1V) and the lower arch electrodes 242*e,c* (+1V). At the intersection of the upper, inner arch electrode 242*b* (−1V), the lower, inner arch electrode 242*c* (+1V), and the center electrode 242*a* (−1V), however, the ion is deflected from its initial axis along equipotential lines around the center electrode 242*a* (−1V) and the lower, inner arch electrode 242*c* (+1V). As such, the cation travels substantially along the non-conductive portion between the center electrode 242*a* (−1V) and the lower, inner arch electrode 242*c* (+1V). At the intersection of the lower, inner arch electrode 242*c* (+1V), the center electrode 242*a* (−1V), and the upper, inner arch electrode 242*b* (−1V), the cation is again deflected along the non-conductive portion extending between the lower, inner arch electrode 242*c* (+1V) and the upper, inner arch electrode (−1V), and is ejected along the non-conductive portion on the left side of FIG. 4. As such, under the exemplary conditions depicted in FIG. 4, the cation can be transmitted through the magnetic ion trap (e.g., into downstream mass analyzer 260), the ejection from the magnetic ion trap again occurring substantially along the central axis (A). It should be appreciated that the arrangement of the electrodes 242*a-e* and the potentials applied thereto in FIG. 4 are merely exemplary, and can be modified in order to otherwise control the motion of the ions in accordance with the present teachings. By way of example, if the polarity of the electrodes 242*a-e* were reversed, it would be appreciated that an anion injected into this modified trap 240 would exhibit substantially the same path through the magnetic ion trap 240 as that depicted for the cation in FIG. 4.

Figure 1:
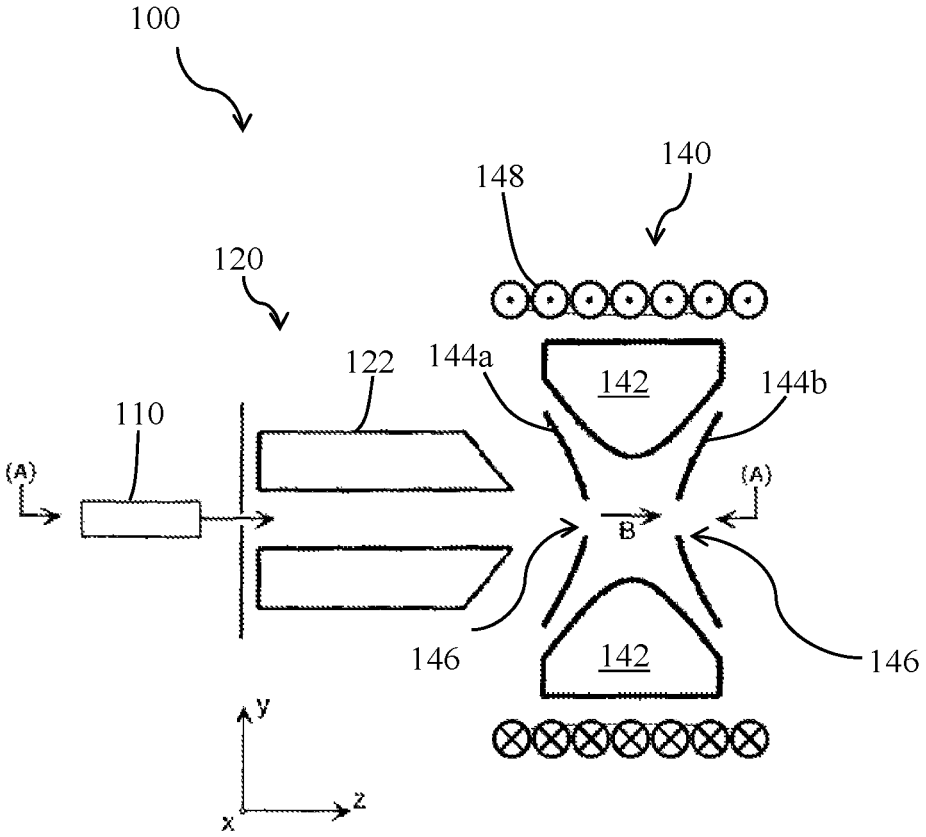
FIG. 1 Prior Art
FIG. 1, in schematic diagram, depicts a known mass spectrometer system incorporating an FT-ICR analyzer.

With reference now to FIG. 5, an exemplary SIMION simulation is depicted demonstrating the trapping of a cation within the magnetic ion trap 240. As shown in FIG. 5, the exemplary potentials applied to the electrodes 242*a-e* are changed relative to the potentials of the electrodes in the injection configuration of FIG. 4, thereby altering the electric field within the ion trap 240. In the trapping configuration, the center electrode 242*a* is switched to the same polarity as the ion(s) to be trapped. As shown in FIG. 5, for example, the DC signal applied to the electrode 242*a* (and the corresponding center electrode 244*a* of electrode 244) is set to +0.2V, while the inner arch electrodes 242*b,c* and outer arch electrodes 242*d,e* are set to potentials of the opposite polarity as the ions to be trapped (e.g., −0.2V and −0.8V, respectively). In this manner, the center electrodes 242*a*, 244*a* function substantially like the end-cap electrodes 144*a,b* of the Penning trap discussed above with reference to FIG. 1, while the ring electrodes 242*b-e* function like the ring electrode 142. That is, the DC voltages applied to the center electrodes 242*a*, 244*a* substantially confine the cation in the direction extending between the electrodes 242, 244 (along the magnetic axis), while the uniform magnetic field within the magnetic ion trap under the conditions of FIG. 5 constrains the motion of the ions about the magnetic axis. As a result of these combined electric and magnetic fields, the trapped cations exhibit both high-frequency cyclotron motion (at a cyclotron frequency dependent on the m/z) and magnetron motion substantially along the non-conductive circle between the center electrode 242*a* and the inner arch electrodes 242*b,c* (with the center of the magnetron motion being the magnetic axis, and perpendicular to the central, injection axis (A)). It will be appreciated that if the trapping voltage is applied quickly, the phase of the cyclotron motion of cations having the same m/z within the magnetic ion trap 240 will be approximately the same (i.e., coherent). Moreover, it will be appreciated that if cations of multiple m/z are trapped simultaneously, each group of cations will exhibit their characteristic cyclotron frequency.

As indicated above, the exemplary system 200 can additionally comprise circuitry for detecting a current induced between various electrodes 242*a-e* due to cation motion within the magnetic ion trap 240. As shown in FIG. 5, for example, AC current tracing electronics 284 can couple the center electrode 242*a* with one or more of the inner arch electrodes 242*b,c* that detects a current induced therebetween, the induced current signal containing the cyclotron frequencies of all ions trapped within the magnetic ion trap 240. That is, as the trapped ions' cyclotron motion travels over the center electrode 242*a* and the inner arch electrodes 242*b,c*, the coherent motion of ions of a particular m/z can induce an AC current between the electrodes, the AC current having a frequency at the cyclotron frequency of each particular m/z. As with conventional FT-ICR analyses, FFT techniques known in the art and modified in accordance with the present teachings can then be performed by processor 282, for example, to deconvolute/convert the time-domain signals of the detected AC current (containing frequency components of each group of ions having a particular m/z)

to a frequency-domain signal, thereby resulting in a mass spectrum of all ions trapped within the magnetic ion trap 240.

In some aspects, if the induced AC current is not sufficiently strong to enable the determination of cyclotron frequencies in the trapping condition as in FIG. 5, for example, the trapped ions can be activated such that the orbit of their cyclotron motion increases. The induced current in this activated state can be detected and deconvoluted in the same manner as discussed above. It will be appreciated that a variety of electrical signals can be used in accordance with the present teachings to activate the ions trapped within the ion trap 240. For example, as in the known Penning trap 140 of FIG. 1, a DC voltage pulse of the same polarity as the trapped ions can be applied to the electrodes 242, 244 to increase the orbit of the trapped cations, as shown in FIG. 6. By way of non-limiting example, a +40V pulse (having a pulse duration of 0.5 μs) can be applied to the center electrode 242*a*, thereby kicking the trapped ions into a larger-diameter orbit, with all ions of a particular m/z remaining in phase. Comparing FIGS. 5 and 6, for example, it is observed that the cyclotron motion of the ion trace following the application of the excitation DC voltage pulse (FIG. 6) exhibits a larger diameter relative to the cyclotron motion of the ion trace in the trapping configuration (FIG. 5).

With this increased movement of the ions, the induced signal between the center electrode 242*a* and inner arch electrodes 242*b,c* can be detected (as described above with reference to FIG. 5), or additionally or alternatively, the induced signal between one or more of the outer arch electrodes 242*d,e* and an inner electrode 242*b,c* can be measured. For example, as shown in FIG. 6, circuitry for detecting a current induced between the outer arch electrodes 242*d,e* and the inner arch electrodes 242*b,c* during ion excitation can be provided. As above, FFT techniques can then be performed by processor 282, for example, to deconvolute/convert the time-domain signals of the detected AC current to a frequency-domain signal, thereby resulting in a mass spectrum of all ions trapped/excited within the magnetic ion trap 240.

Figure 7:
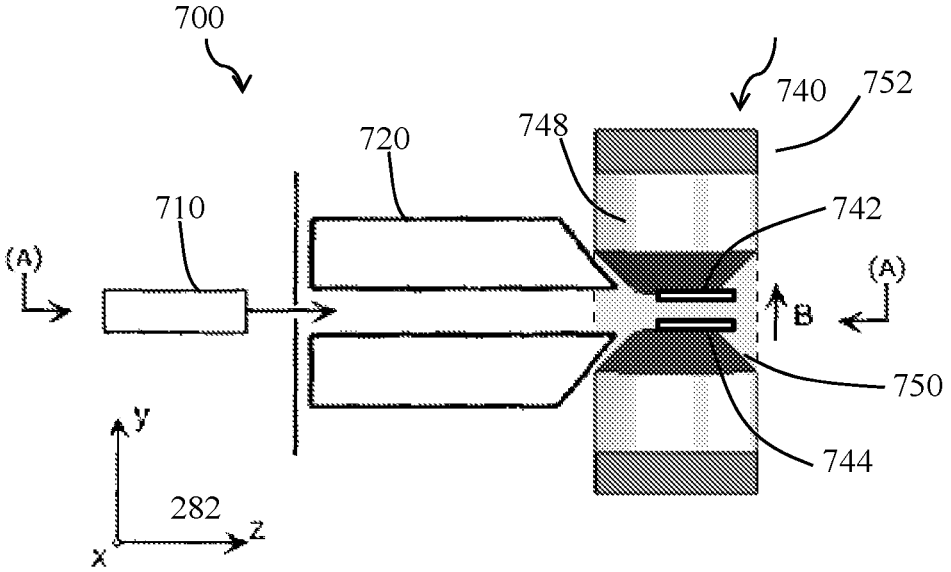
FIG. 7, in schematic diagram, depicts another exemplary mass spectrometer system having a magnetic ion trap in accordance with one aspect of various embodiments of the applicant's teachings.
Figure 8:
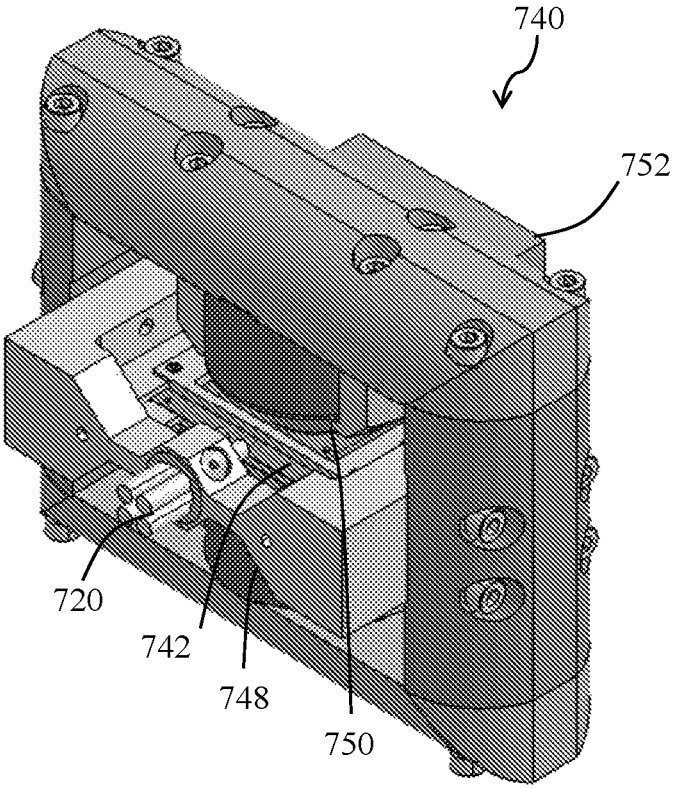
FIG. 8, in perspective view, depicts a prototype of the exemplary magnetic ion trap and ion guide of FIG. 7.

With reference now to FIG. 7-8, another exemplary mass spectrometer system 700 incorporating a magnetic ion trap 740 in accordance with various aspects of the present teachings is depicted. The mass spectrometer system 700 is similar to that described above with reference to FIG. 2, in that it includes an ion source 710, an ion guide 720, and a magnetic ion trap 740 configured to receive ions along a central axis (A) that is substantially perpendicular to the magnetic field (B) generated within the magnetic ion trap 740. Like the magnetic ion trap 240 of FIG. 2, the magnetic ion trap 740 also includes a plurality of electrodes 742, 744 disposed on opposed sides of the central axis (A) for generating an electric field within the magnetic ion trap 740 as otherwise discussed herein.

The exemplary magnetic ion trap 740 differs from that described above with reference to FIG. 2, however, in that the magnetic ion trap 740 is not configured to transmit ions therefrom into a downstream mass analyzer. Rather, the magnetic ion trap 740 represents the terminal detector of the mass spectrometer system 700. It will nonetheless be appreciated that additional mass analyzer elements can be included upstream of the magnetic ion trap 740 (i.e., between the ion source 710 and the magnetic ion trap 740) to process and/or analyze the ions to be injected therein. By way of non-limiting example, an upstream collision cell can be included within the system 700 such that ions generated from a sample can be dissociated to allow for the analysis of one or more product ions within the magnetic ion trap 740.

As shown in FIG. 7, the magnetic ion trap 740 contains additional features relative to those shown in FIG. 2 for increasing the strength and/or uniformity of the magnetic field within the gap between the electrodes 742, 744. It will be appreciated, however, that although these features are discussed with specific reference to the magnetic ion trap 740, the teachings are equally applicable to various aspects of the system 200 of FIG. 2 in order to increase the uniformity and/or the magnetic flux density of the magnetic field within the magnetic ion trap 240.

As shown in FIG. 7, the magnetic ion trap 740 comprises a plurality of disc magnets 748 disposed relative to one another such that the magnetic field (B) is generated therebetween with its magnetic field axis being substantially perpendicular to the central axis (A) within the magnetic ion trap 740. Additionally, each of the disc magnets 748 includes pole pieces 750 extending from the disc magnets 748 toward the central axis (A). It will be appreciated that pole piece 750 are not limited to any particular shape and can have a variety of different configurations, but are generally configured to amplify the magnetic field generated by the disc magnets 748 by reducing the distance across which the magnetic field is applied and/or by reducing the surface area of the opposed surfaces of the magnetic field generator (i.e., focusing the magnetic field from the larger diameter disc magnets 748 through the smaller terminal surface area provided by the pole pieces 750).

By way of non-limiting example, each of the exemplary pole pieces 750 can be coupled to the substantially planar surface of a respective disc magnet 748 and can comprise a piece of magnetic material of a truncated conical shape having a reduced diameter as it approaches the central axis (A). It will be appreciated by a person skilled in the art that the pole pieces 750 can be a magnetic material (the same or different as the permanent magnets 748). By way of non-limiting example, the magnets 748 can comprise neodymium, with the pole pieces 750 being iron.

As shown in FIG. 7, the electrodes 742, 744 can be supported by (e.g., coupled to, mounted on, glued) these reduced-diameter terminal ends of the pole pieces 750. It should be also noted with reference to FIG. 8 that the electrodes 742, 744 (e.g., PCBs) can have a larger surface area than the surface area terminal ends of the pole pieces 750.

As shown in FIGS. 7 and 8, the exemplary magnetic ion trap 740 additionally includes a magnetic flux return yoke 752 connecting the magnets 748, the yoke 752 forming part of the magnetic circuit for closing the flux loop. It will be appreciated by a person skilled in the art that the yoke 752 can be a magnetic piece of material (the same or different as the permanent magnets 748). By way of non-limiting example, the magnets 748 can comprise neodymium and the yoke 752 extending therebetween can comprise soft magnetic iron or pure iron.

Figure 9:
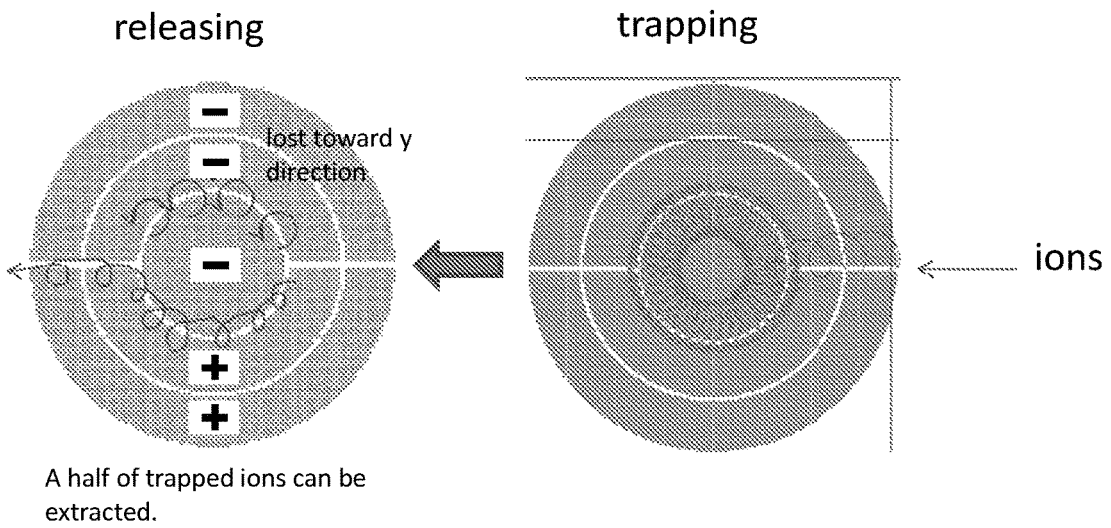
FIG. 9 depicts a simulation demonstrating the path of exemplary ions in trapping and releasing embodiments of the present teachings.

Now referring to FIG. 9, a demonstration of ion motion in a trapping mode and a releasing mode are depicted in the exemplary PCB electrode 242 of FIG. 3. The ion motion in trapping mode operates in much the same manner as depicted using the exemplary PCB electrode 242 depicted in FIG. 5 with polarities modified accordingly. In releasing mode, the polarity of some of the electrodes changes. Thereafter, the trapped ions can be divided into two groups of ions delineated generally as the horizontal midpoint of the plurality of electrodes. Ions that are located in the bottom hemisphere, located below the horizontal midpoint are thereby released from the magnetic ion trap towards the left, and towards any further processing mechanisms which can include further ion guides, traps, detectors or mass spectrometers, etc. Trapped ions located above the horizontal midpoint are generally lost towards the y direction. Therefore, only approximately half of any trapped ions can be recovered from the magnetic ion trap.

Figure 10:
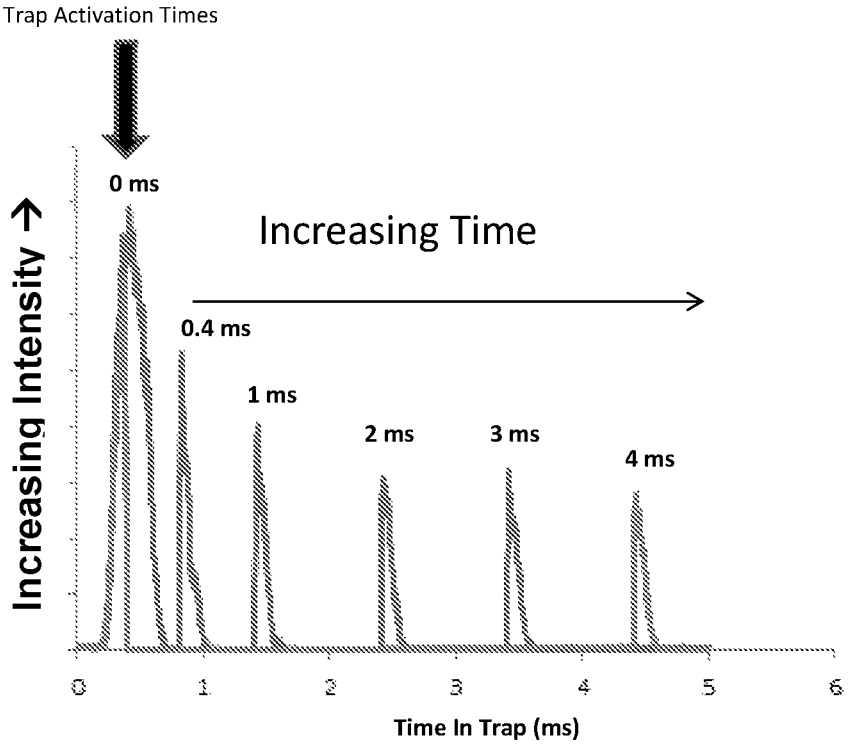
FIG. 10 depicts ion intensity measurements as measured with varying trap activation times for short time frame.

This phenomenon is more easily demonstrated by reference to FIG. 10 which depicts the operation of an exemplary magnetic ion trap in accordance with the present teachings that operates with varying increasing trap activation times. As would be understood, it is intended when referring to a trap activation time, to represent a magnetic ion trap configured to operate for example in a manner similar to that depicted in FIG. 5 and 6. At a trap activation time of 0 ms, the ion trap is operating in a flow through manner with the ion motion similar to that shown in FIG. 4. As indicated, the intensity of the resulting ion bean peaks at a given level, at time of 0.5 ms with a time width approximately of 0.5 ms which represents a bunched ion beam generated by ion source 710, where the ion source includes an electron spray ionization source and an RF quadrupole isolation device that feeds into the magnetic ion trap. This time measurement represents the transit time of the bunched ion beam through the magnetic ion trap where no trapping takes place. When the trap activation time is increased to 1 ms and higher, the maximum intensity of the resulting ion beam drops to approximately half. At a trap activation time of 0.4 ms, the intensity drops to an intermediate intensity. This represents a scenario where some of the incoming ions into the ion trap in trapping mode do not have sufficient time to make one entire revolution through the trap before the trapping mode is disabled and the ions are released. These ions do not feel the effects of the trapping mode and essentially flow through the magnetic ion trap in a manner similar to that shown in FIG. 4. This results in a higher concentration of trapped ions in the lower hemisphere compared to the upper hemisphere at the time of the trapping mode being disabled.

Figure 11:
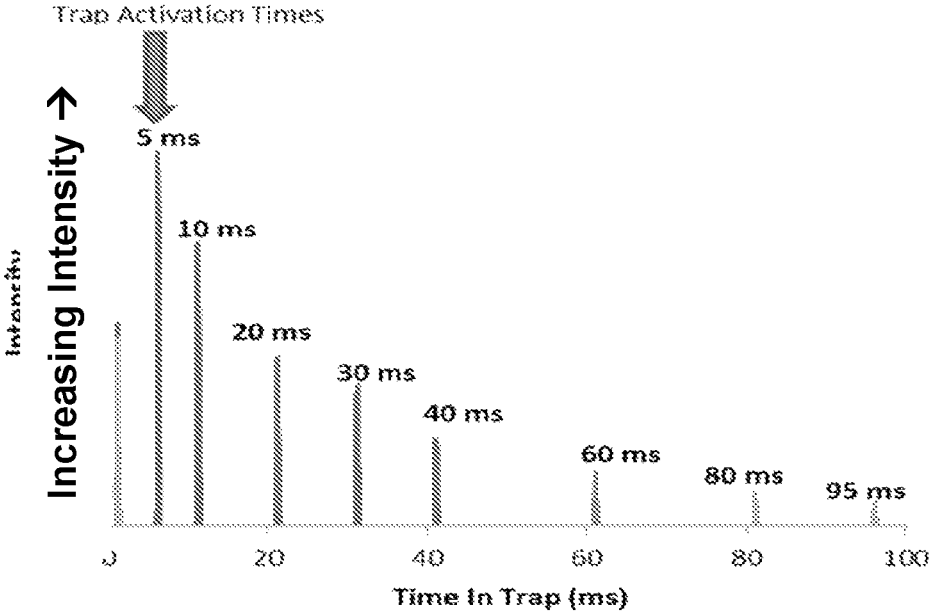
FIG. 11 depicts ion intensity measurements as measured with varying trap activation times for longer time frames.
Figure 12:
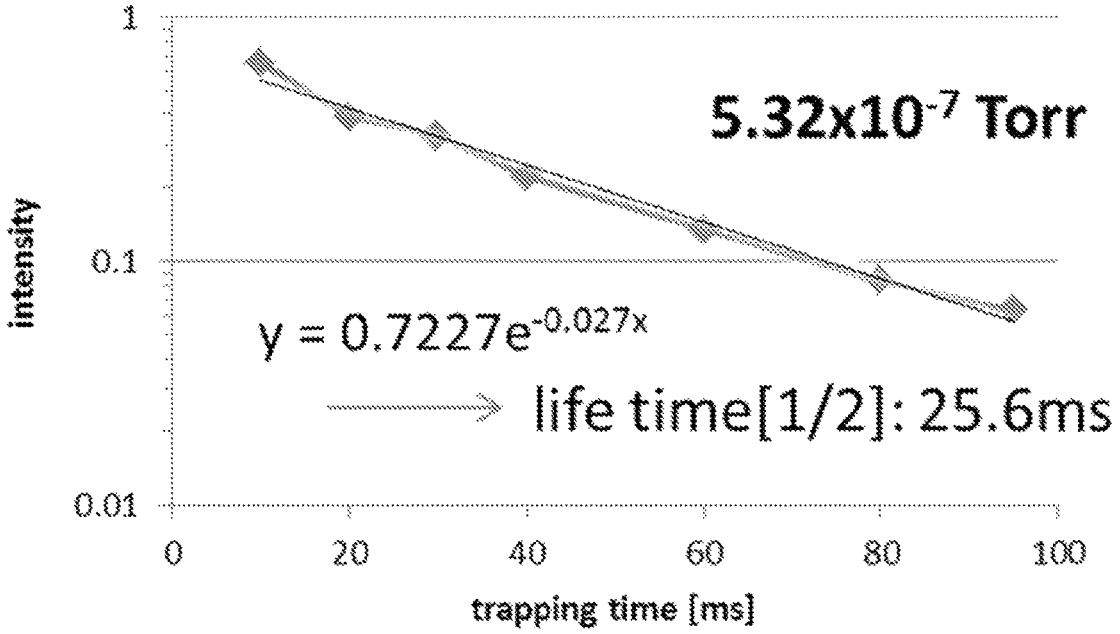
FIG. 12 provides a plot for determining the half life of ions in a trapping mechanism exemplified by the data provided in FIG. 11.

With increasing trap activation times, the intensity of ions continues to decrease as a result of ions generally lost in the trap as depicted in FIG. 11. With this data, it is possible to determine an approximate half-life of a specific ion entering the ion trap which was found to be approximately 25.6 ms as shown in FIG. 12.

It will be appreciated by a person skilled in the art that the magnetic and electric fields can be modified in order to trap the ions or otherwise control the ions' motion to enable FT-ICR analysis in accordance with the present teachings. By way of example, it will be appreciated that the dimensions, arrangement, and material of the magnets (e.g., permanent magnets 248, 748) can be selected depending on the desired characteristics of the magnetic field generated thereby. By way of example, two neodymium magnets of 2" diameter and 1" thickness (N52 grade) separated by a gap of about 0.1" may be sufficient for some applications, though applications requiring high accuracy could benefit from a stronger magnetic field (e.g., a magnetic field generated between 4" diameter neodymium magnets having pole pieces as described with reference to FIG. 7 such that the gap between the electrodes 742, 744 is about 0.1" with a diameter of about 1").

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A mass spectrometer system, comprising:

a magnetic ion trap extending from an input end to a distal end along a central axis, the input end configured to receive ions from an ion source, the magnetic ion trap comprising:

at least one magnet for generating within the magnetic ion trap a magnetic field substantially perpendicular to the central axis; and a plurality of electrodes to which electric signals are applied so as to generate an electric field within the magnetic ion trap, the plurality of electrodes extending along opposed sides of the central axis, wherein the magnetic and electric fields are configured to cause ions within the magnetic ion trap to exhibit cyclotron and magnetron motion.

2. The mass spectrometer system of claim 1, further comprising a detector to detect an induced current between at least two of the plurality of electrodes.

3. The mass spectrometer of claim 2, wherein the detector comprises AC current tracing electronics.

4. The mass spectrometer system of claim 2, wherein at least one of the plurality of electrodes are configured to have an excitation signal applied thereto so as to increase the orbit of the cyclotron motion of the ions, and wherein the detector is configured to detect an induced current between at least two of the plurality of electrodes during excitation of the ions and optionally wherein the excitation signal comprises a DC pulse applied to at least one of the plurality of electrodes.

5. The mass spectrometer system of claim 2, further comprising a processor configured to analyze the detected induced current using Fourier analysis.

6. The mass spectrometer of claim 1, further comprising an ion source and an ion guide disposed between the ion source and the input end of the magnetic ion trap, wherein the ion guide is configured to transmit ions into the magnetic ion trap along the central axis and optionally wherein the mass spectrometer further comprises a downstream mass analyzer configured to receive ions from the magnetic ion trap along the central axis.

7. The mass spectrometer of claim 1, wherein the magnetic field exhibits a strength of at least about 2 T along a magnetic field axis extending between the plurality of electrodes and optionally wherein the magnetic field is substantially uniform between the electrodes in a direction along the magnetic field axis and/or the central axis.

8. The mass spectrometer system of claim 1, wherein the at least one magnet comprises first and second permanent disc magnets disposed on opposed sides of the central axis.

9. The mass spectrometer system of claim 8, wherein each of the first and second permanent disc magnets terminate in a substantially planar surface so as to define a gap between the planar, parallel surfaces of the first and second permanent disc magnets across the central axis.

10. The mass spectrometer system of claim 8, wherein the first and second permanent disc magnets comprise neodymium.

11. The mass spectrometer system of claim 8, wherein the first and second disc permanent magnets are cylindrical and the mass spectrometer system further comprises first and second truncated, conical portions extending from terminal ends of the first and second permanent disc magnets respectively, wherein each of the first and second truncated, conical portions terminate in a planar surface having a reduced area relative to the area of the terminal ends of the first and second permanent disc magnets, and wherein a gap between the parallel, planar surfaces of the first and second truncated, conical portions is defined across the central axis and optionally wherein the first and second permanent disc magnets comprise neodymium and optionally wherein the first and second truncated, conical portions comprise iron.

12. The mass spectrometer system of claim 8, wherein the first and second permanent disc magnets are coupled via a magnetic flux return yoke.

13. The mass spectrometer system of claim 1, wherein the plurality of electrodes extending along opposed sides of the central axis comprise a first set of a plurality of electrodes disposed on one side of the central axis and a second set of a plurality of electrodes disposed on the opposed side of the central axis.

14. The mass spectrometer system of claim 13, wherein each of the first and second set of the plurality of electrodes comprises a plurality of substantially planar electrodes, said first and second set being disposed on opposed sides of the central axis.

15. The mass spectrometer system of claim 14, wherein each of the plurality of substantially planar electrodes are formed on a printed circuit board and optionally wherein the printed circuit boards are supported by said magnets.

16. The mass spectrometer system of claim 14, wherein the first set of the plurality of electrodes comprises a central circular electrode and at least two electrodes that surround the central circular electrode.

17. The mass spectrometer system of claim 16, wherein said at least two electrodes that surround the central circular electrode comprise an inner ring of electrodes.

18. The mass spectrometer system of claim 17, further comprising a detector to detect an induced current between an electrode of the inner ring and the central circular electrode.

19. The mass spectrometer system of claim 17, further comprising an outer ring of electrodes surrounding the inner ring of electrodes, and optionally wherein the mass spectrometer system comprises a detector to detect an induced current between an electrode of the inner ring and an electrode of the outer ring.

20. A method of analyzing ions, comprising:

receiving along a central axis a plurality of ions at an input end of a magnetic ion trap, the magnetic ion trap comprising:

at least one magnet for generating within the magnetic ion trap a magnetic field substantially perpendicular to the central axis; and a plurality of electrodes to which electric signals are applied so as to generate an electric field within the magnetic ion trap; and trapping the plurality of ions within the magnetic ion trap such that the ions exhibit cyclotron and magnetron motion within the magnetic ion trap.

21. The method of claim 20, further comprising detecting an induced current between at least two of the plurality of electrodes.

22. The method of claim 20, further comprising detecting an induced current between at least two of the plurality of electrodes after applying an excitation signal to at least one of the plurality of electrodes so as to increase the orbit of the cyclotron motion of the ions and optionally wherein applying the excitation signal comprises applying a DC pulse applied to at least one of the plurality of electrodes.

23. The method of claim 20, further comprising using Fourier analysis to convert the detected induced current to determine the cyclotron motion frequencies of the trapped ions.

24. The method of claim 20, wherein the plurality of electrodes extending along opposed sides of the central axis comprise a first set of a plurality of electrodes disposed on one side of the central axis and a second set of a plurality of electrodes disposed on the opposed side of the central axis and the first set and the second set of the plurality of electrodes comprise a first and second yoke board and wherein the plurality of electrodes comprise a central circular electrode and an inner ring electrodes surrounding the central circular electrode and optionally wherein the method further comprises detecting an induced current between an electrode of the inner ring and the central circular electrode.

25. The method of claim 20, further comprising an outer ring of electrodes surrounding the inner ring of electrodes and the method further comprising detecting an induced current between an electrode of the inner ring and an electrode of the outer ring.

* * * * *